US010170035B2

(12) United States Patent
Park

(10) Patent No.: US 10,170,035 B2
(45) Date of Patent: Jan. 1, 2019

(54) ORGANIC LIGHT-EMITTING DIODE DISPLAY

(71) Applicant: Samsung Display Co., Ltd., Yongin, Gyeonggi-Do (KR)

(72) Inventor: Jung-Kook Park, Cheonan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 60 days.

(21) Appl. No.: 14/750,359

(22) Filed: Jun. 25, 2015

(65) Prior Publication Data

US 2016/0049113 A1 Feb. 18, 2016

(30) Foreign Application Priority Data

Aug. 13, 2014 (KR) ..... 10-2014-0104902

(51) Int. Cl.

| | |
|---|---|
| ***G09G 5/00*** | (2006.01) |
| ***G09G 3/3208*** | (2016.01) |
| ***G09G 3/3258*** | (2016.01) |
| ***G09G 3/3266*** | (2016.01) |

(Continued)

(52) U.S. Cl.

CPC ..... *G09G 3/3208* (2013.01); *G09G 3/3225* (2013.01); *G09G 3/3258* (2013.01); *G09G 3/3266* (2013.01); *G09G 3/3275* (2013.01); *G09G 2300/0473* (2013.01); *G09G 2300/0866* (2013.01); *G09G 2320/029* (2013.01); *G09G 2320/0223* (2013.01); *G09G 2320/0233* (2013.01); *G09G 2320/0626* (2013.01);

(Continued)

(58) Field of Classification Search

CPC ... G09G 2300/0473; G09G 2300/0866; G09G 2320/0223; G09G 2320/0233; G09G 2320/029; G09G 2320/0626; G09G 2320/0673; G09G 2330/021; G09G 2360/16; G09G 3/3208; G09G 3/3225; G09G 3/3258; G09G 3/326

See application file for complete search history.

(56) References Cited

U.S. PATENT DOCUMENTS

| | | | |
|---|---|---|---|
| 7,136,038 | B2 | 11/2006 | Ha et al. |
| 7,187,375 | B2 | 3/2007 | Ha et al. |
| 8,330,754 | B2 | 12/2012 | Byun et al. |

(Continued)

FOREIGN PATENT DOCUMENTS

| | | | |
|---|---|---|---|
| CN | 1506932 | A | 6/2004 |
| CN | 1577446 | A | 2/2005 |

(Continued)

*Primary Examiner* — Insa Sadio

(74) *Attorney, Agent, or Firm* — Lewis Roca Rothgerber Christie LLP

(57) ABSTRACT

An OLED display is disclosed. The display includes a display panel having a luminance level of the display panel, a power supply unit providing first and second power voltages to the display panel, and a gamma reference voltage generator configured to i) generate a compensation gamma reference voltage, ii) detect a voltage level of the first power voltage at a detection point of the display panel, ii) change the compensation gamma reference voltage from a first voltage level to a second voltage level within a frame based at least in part on the detected voltage level, and iv) determine the first voltage level of the compensation gamma reference voltage based at least in part on the luminance level.

12 Claims, 9 Drawing Sheets

(51) Int. Cl.
*G09G 3/3275* (2016.01)
*G09G 3/3225* (2016.01)

(52) U.S. Cl.
CPC ..... *G09G 2320/0673* (2013.01); *G09G 2330/021* (2013.01); *G09G 2360/16* (2013.01)

(56) References Cited

U.S. PATENT DOCUMENTS

| | | | | |
|---|---|---|---|---|
| 2004/0179029 | A1* | 9/2004 | Ogawa | G09G 3/3688 345/690 |
| 2008/0007494 | A1* | 1/2008 | Kim | G09G 3/3225 345/77 |
| 2012/0249514 | A1 | 10/2012 | Ahn | |
| 2013/0063498 | A1 | 5/2013 | Yabukane | |
| 2013/0135272 | A1 | 5/2013 | Park | |
| 2013/0162622 | A1* | 6/2013 | Ebisuno | G09G 3/3208 345/212 |
| 2013/0176349 | A1 | 7/2013 | Park et al. | |
| 2014/0152721 | A1 | 6/2014 | Byun et al. | |
| 2014/0198090 | A1* | 7/2014 | Park | G09G 3/3291 345/212 |

FOREIGN PATENT DOCUMENTS

| | | | |
|---|---|---|---|
| CN | 101814267 | A | 8/2010 |
| KR | 10-2012-0074946 | A | 7/2012 |
| KR | 10-2012-0111675 | A | 10/2012 |
| KR | 10-1273337 | B1 | 6/2013 |
| KR | 10-2013-0081451 | A | 7/2013 |

* cited by examiner

ORGANIC LIGHT-EMITTING DIODE DISPLAY

CROSS-REFERENCE TO RELATED APPLICATIONS

This application claims priority from and the benefit of Korean Patent Applications No. 10-2014-0104902 , filed on Aug. 13, 2014 in the Korean Intellectual Property Office (KIPO), the disclosure of which is hereby incorporated by reference herein in its entirety.

BACKGROUND

Field

The described technology generally relates to organic light-emitting diode displays.

Description of the Related Technology

Large organic light-emitting diode (OLED) displays are being researched and developed. OLED displays generate an emission current proportional to a voltage difference between a power voltage (e.g., a high power voltage ELVDD) applied to a display panel and a data signal. Luminance and chromaticity of an OLED are adjusted according to the emission current magnitude.

A voltage drop (i.e., IR drop) of the power voltage is caused by resistance of power lines transmitting the power voltages to the display panel. The voltage drop changes according to luminance or gray level. Thus, a deviation of luminance of a display image between internal areas of the display panel is generated.

SUMMARY OF CERTAIN INVENTIVE ASPECTS

One inventive aspect is an OLED display compensating a gamma reference voltage according to a change of average gray level of a display panel.

Another aspect is an OLED display compensating a gamma reference voltage according to a change of luminance level of a display panel.

Another aspect is an OLED display compensating a gamma reference voltage using different methods according to a change of gray level and/or a change of luminance level.

Another aspect is an OLED display that comprises a display panel including a plurality of pixels, a power supply unit configured to provide a first power voltage and a second power voltage to the display panel, a gamma reference voltage generator configured to output a compensation gamma reference voltage of a gamma reference voltage to change to a second voltage level from a first voltage level within a frame based on a detected voltage level of the first power voltage detected at the display panel, and to determine the first voltage level of the compensation gamma reference voltage according to a luminance level of the display panel that corresponds to a dimming level of the display panel, a gamma voltage generator configured to output a plurality of gamma voltages by dividing the compensation gamma reference voltage, and a data driver configured to generate a data signal corresponding to the gamma voltages, and provide the data signal to the display panel.

In example embodiments, the gamma reference voltage generator includes a luminance level detection unit configured to detect the luminance level of the display panel, a lookup table having the first voltage level of the compensation gamma reference voltage corresponding to the luminance level, a detection unit configured to calculate a voltage difference between the detected voltage level of the first power voltage at a detection point of the display panel and a reference voltage, and a gamma reference voltage compensation unit configured to determine the first voltage level of the compensation gamma reference voltage referring to the lookup table, and determine the second voltage level of the compensation gamma reference voltage based on the voltage difference.

In example embodiments, the first voltage level is a maximum value of the compensation gamma reference voltage of the frame, and the second voltage level can be a minimum value of the compensation gamma reference voltage of the frame.

In example embodiments, the gamma reference voltage compensation unit determines the second voltage level of the compensation gamma reference voltage by adding the voltage difference to a minimum value of the gamma reference voltage of the frame.

In example embodiments, the reference voltage is the detected voltage level of the first power voltage that is detected at the detection point when the display panel emits light to have a maximum luminance level and a maximum gray level.

In example embodiments, the gamma reference voltage generator outputs the compensation gamma reference voltage to linearly decrease from the first voltage level to the second voltage level during a first duration.

In example embodiments, the gamma reference voltage generator outputs the second voltage level of the compensation gamma reference voltage during a second duration.

In example embodiments, the first duration corresponds to a duration in which the data signal is applied to a first area of the display panel. The second duration can correspond to a duration in which the data signal is applied to a second area of the display panel.

In example embodiments, the first area is closer to the data driver than the detection point, and the second area is a remaining area of the display panel adjacent to the first area.

In example embodiments, the detection point corresponds to a portion of a center line of the display panel, the center line being substantially parallel to the scan line.

Another aspect is an OLED display that comprises a display panel including a plurality of pixels, a power supply unit configured to provide a first power voltage and a second power voltage to the display panel, a gamma reference voltage generator configured to output a compensation gamma reference voltage of a gamma reference voltage to change to a second voltage level from a first voltage level within a frame based on a detected voltage level of the first power voltage detected at the display panel, and to determine the second voltage level of the compensation gamma reference voltage according to an average gray level of the display panel, a gamma voltage generator configured to output a plurality of gamma voltages by dividing the compensation gamma reference voltage, and a data driver configured to generate a data signal corresponding to the gamma voltages, and provide the data signal to the display panel.

In example embodiments, the gamma reference voltage generator includes a gray level detection unit configured to detect the average gray level of the display panel based on an image data, a lookup table having the second voltage level of the compensation gamma reference voltage corresponding to the average gray level, a detection unit configured to calculate the voltage difference between the detected voltage level of the first power voltage at a detection point of the display panel and a reference voltage, and a gamma reference voltage compensation unit configured to determine the second voltage level of the compensation gamma reference voltage referring to the lookup table, and determine the first voltage level of the compensation gamma reference voltage based on the voltage difference.

In example embodiments, the first voltage level is a maximum value of the compensation gamma reference voltage, and the second voltage level can be a minimum value of the compensation gamma reference voltage.

In example embodiments, the gamma reference voltage compensation unit determines the first voltage level of the compensation gamma reference voltage by subtracting the voltage difference from a maximum value of the gamma reference voltage of the frame.

In example embodiments, the reference voltage is the detection voltage of the first power voltage that is detected at the detection point when the display panel emits light to have a maximum luminance level and a maximum gray level.

In example embodiments, the gamma reference voltage generator outputs the compensation gamma reference voltage to linearly decrease from the first voltage level to the second voltage level during a first duration, and output the second voltage level of the compensation gamma reference voltage during a second duration.

In example embodiments, the first duration corresponds to a duration in which the data signal is applied to a first area of the display panel in the frame. The second duration can correspond to a duration in which the data signal is applied to a second area of the display panel in the frame.

In example embodiments, the first area is closer to the data driver than the detection point, and the second area is a remaining area of the display panel adjacent to the first area.

Another aspect is an OLED display that comprises a display panel including a plurality of pixels, a power supply unit configured to provide a first power voltage and a second power voltage to the display panel, a gamma reference voltage generator configured to output a compensation gamma reference voltage of a gamma reference voltage to change to a second voltage level from a first voltage level within a frame based on a detected voltage level of the first power voltage detected at the display panel, to determine the first voltage level of the compensation gamma reference voltage according to a luminance level of the display panel that corresponds to a dimming level of the display panel, and to determine the second voltage, level of the compensation gamma reference voltage according to a average gray level of the display panel, a gamma voltage generator configured to output a plurality of gamma voltages by dividing the compensation gamma reference voltage, and a data driver configured to generate a data signal corresponding to the gamma voltages, and provide the data signal to the display panel.

In example embodiments, when the luminance level is maintained to have uniform level and the average gray level is changed, the gamma reference voltage generator determines the first voltage level of the compensation gamma reference voltage referring to a first lookup table that has the first voltage level of the compensation gamma reference voltage corresponding to the luminance level, and determine the second voltage level of the compensation gamma reference voltage based on a voltage difference between the detected voltage level of the first power voltage at a detection point of the display panel and a reference voltage.

In example embodiments, when the average gray level is maintained to have uniform level and the luminance level is changed, the gamma reference voltage generator determines the first voltage level of the compensation gamma reference voltage based on the voltage difference between the detected voltage level of the first power voltage at the detection point of the display panel and the reference voltage, and determine the second voltage level of the compensation gamma reference voltage referring to a second lookup table that has the second voltage level of the compensation gamma reference voltage corresponding to the average gray level.

Another aspect is an organic light-emitting diode (OLED) display comprising a display panel including a plurality of pixels and having a luminance level of the display panel, a power supply unit configured to provide first and second power voltages to the display panel, and a gamma reference voltage generator configured to i) generate a compensation gamma reference voltage, ii) detect a voltage level of the first power voltage at a detection point of the display panel, ii) change the compensation gamma reference voltage from a first voltage level to a second voltage level within a frame based at least in part on the detected voltage level, and iv) determine the first voltage level of the compensation gamma reference voltage based at least in part on the luminance level. The display also includes a gamma voltage generator configured to divide the compensation gamma reference voltage so as to output a plurality of gamma voltages, and a data driver configured to generate a data signal corresponding to the gamma voltages and provide the data signal to the display panel.

In the above display, the gamma reference voltage generator comprises a luminance level detector configured to detect the luminance level, a lookup table storing the first voltage level of the compensation gamma reference voltage corresponding to the luminance level, and a detector configured to calculate a voltage difference between the detected voltage level at the detection point of the display panel and a reference voltage. In the above display, the gamma reference voltage generator also includes a gamma reference voltage compensation unit configured to i) receive the first voltage level of the compensation gamma reference voltage from the lookup table, and ii) determine the second voltage level of the compensation gamma reference voltage based at least in part on the voltage difference.

In the above display, the first and second voltage levels respectively include maximum and minimum values of the compensation gamma reference voltage of the frame.

In the above display, the gamma reference voltage compensation unit is further configured to add the voltage difference to the minimum value of the gamma reference voltage of the frame so as to determine the second voltage level of the compensation gamma reference voltage.

In the above display, the detector is further configured to detect the voltage level when the display panel emits light having a maximum luminance level and a maximum gray level, wherein the reference voltage corresponds to the detected voltage level.

In the above display, the gamma reference voltage generator is further configured to substantially linearly decrease the compensation gamma reference voltage from the first voltage level to the second voltage level during a first duration.

In the above display, the gamma reference voltage generator is further configured to output the compensation gamma reference voltage having the second voltage level during a second duration.

In the above display, the first duration corresponds to a duration in which the data signal is applied to a first area of the display panel, wherein the second duration corresponds to a duration in which the data signal is applied to a second area of the display panel.

In the above display, the first area is closer to the data driver than the detection point, wherein the second area includes a remaining area of the display panel adjacent to the first area.

In the above display, the detection point corresponds to a portion of a center line of the display panel, and the center line is substantially parallel to the scan line.

Another aspect is an OLED display comprising a display panel including a plurality of pixels and having an average gray level, a power supply unit configured to provide first and second power voltages to the display panel, and a gamma reference voltage generator configured to i) generate a compensation gamma reference voltage of a gamma reference voltage, ii) detect a voltage level of the first power voltage at the display panel, iii) change the compensation gamma reference voltage from a first voltage level to a second voltage level within a frame based at least in part on the detected voltage level, and iv) determine the second voltage level of the compensation gamma reference voltage based at least in part on the average gray level. The display also comprises a gamma voltage generator configured to divide the compensation gamma reference voltage so as to output a plurality of gamma voltages, and a data driver configured to generate a data signal corresponding to the gamma voltages and provide the data signal to the display panel.

In the above display, the gamma reference voltage generator comprises a gray level detector configured to detect the average gray level based at least in part on image data, a lookup table storing the second voltage level of the compensation gamma reference voltage corresponding to the average gray level, and a detector configured to calculate the voltage difference between the detected voltage level at a detection point of the display panel and a reference voltage. The above display also includes a gamma reference voltage compensation unit configured to i) receive the second voltage level of the compensation gamma reference voltage from the lookup table, and ii) determine the first voltage level of the compensation gamma reference voltage based at least in part on the voltage difference.

In the above display, the first and second voltage levels respectively include maximum and minimum values of the compensation gamma reference voltage.

In the above display, the gamma reference voltage compensation unit is further configured to subtract the voltage difference from the maximum value of the gamma reference voltage of the frame so as determine the first voltage level of the compensation gamma reference voltage.

In the above display, the detector is further configured to detect the voltage level when the display panel emits light having a maximum luminance level and a maximum gray level, wherein the reference voltage corresponds to the detected voltage level.

In the above display, the gamma reference voltage generator is further configured to i) substantially linearly decrease the compensation gamma reference voltage from the first voltage level to the second voltage level during a first duration, and ii) output the compensation gamma reference voltage having the second voltage level during a second duration.

In the above display, the first duration corresponds to a duration in which the data signal is applied to a first area of the display panel in the frame, wherein the second duration corresponds to a duration in which the data signal is applied to a second area of the display panel in the frame.

In the above display, the first area is closer to the data driver than the detection point, and wherein the second area includes a remaining area of the display panel adjacent to the first area.

Another aspect is an OLED display comprising a display panel including a plurality of pixels and having an average gray level and a luminance level of the display panel, a power supply unit configured to provide first and second power voltages to the display panel, and a gamma reference voltage generator configured to i) generate a compensation gamma reference voltage of a gamma reference voltage, ii) detect a voltage level of the first power voltage at the display panel, iii) change the compensation gamma reference voltage from a first voltage level to a second voltage level within a frame based at least in part on the detected voltage level, iv) determine the first voltage level of the compensation gamma reference voltage based at least in part on the luminance level and v) determine the second voltage level of the compensation gamma reference voltage based at least in part on the average gray level. The display also comprises a gamma voltage generator configured to divide the compensation gamma reference voltage so as to output a plurality of gamma voltages, and a data driver configured to generate a data signal corresponding to the gamma voltages and provide the data signal to the display panel.

In the above display, when the luminance level is maintained to have a substantially uniform level and the average gray level is changed, the gamma reference voltage generator is further configured to i) receive the first voltage level from a first lookup table having the first voltage level corresponding to the luminance level, and ii) determine the second voltage level based at least in part on a voltage difference between the detected voltage level and a reference voltage. In the above display, when the average gray level is maintained to have a substantially uniform level and the luminance level is changed, the gamma reference voltage generator is further configured to i) determine the first voltage level of the compensation gamma reference voltage based at least in part on the voltage difference between the detected voltage level and the reference voltage, and ii) receive the second voltage level from a second lookup table having the second voltage level corresponding to the average gray level.

According to at least one of the disclosed embodiments, the OLED display can independently determine the first voltage level and the second voltage level of the compensation gamma reference voltage. In some embodiments, the OLED display adjusts the voltage difference between the first voltage level and the second voltage level of the compensation gamma reference voltage according to the change of the average gray level or change of the luminance level so that optimal gamma voltage (or the data signal) based on the compensation gamma reference voltage is selected. Thus, the deviation of luminance between internal areas of the display panel can be effectively removed.

DETAILED DESCRIPTION OF CERTAIN INVENTIVE EMBODIMENTS

Data signals corresponding to a gamma voltage are generated based on a voltage level of a gamma reference voltage. Recently, the gamma reference voltage is being compensated (or corrected) based on the voltage drop of the power voltage to improve the deviation in luminance of the displayed image. The compensation gamma reference voltage is uniformly changed in proportion to the voltage drop. The deviations of luminance of an image are not perfectly removed at all luminance levels (or dimming levels). Typical compensation methods result in specific colors (e.g., reddish, greenish, and/or bluish hues) being more pronounced at low gray levels.

Exemplary embodiments will be described more fully hereinafter with reference to the accompanying drawings, in which various embodiments are shown. In this disclosure, the term "substantially" includes the meanings of completely, almost completely or to any significant degree under some applications and in accordance with those skilled in the art. Moreover, "formed on" can also mean "formed over." The term "connected" can include an electrical connection.

Figure 1:
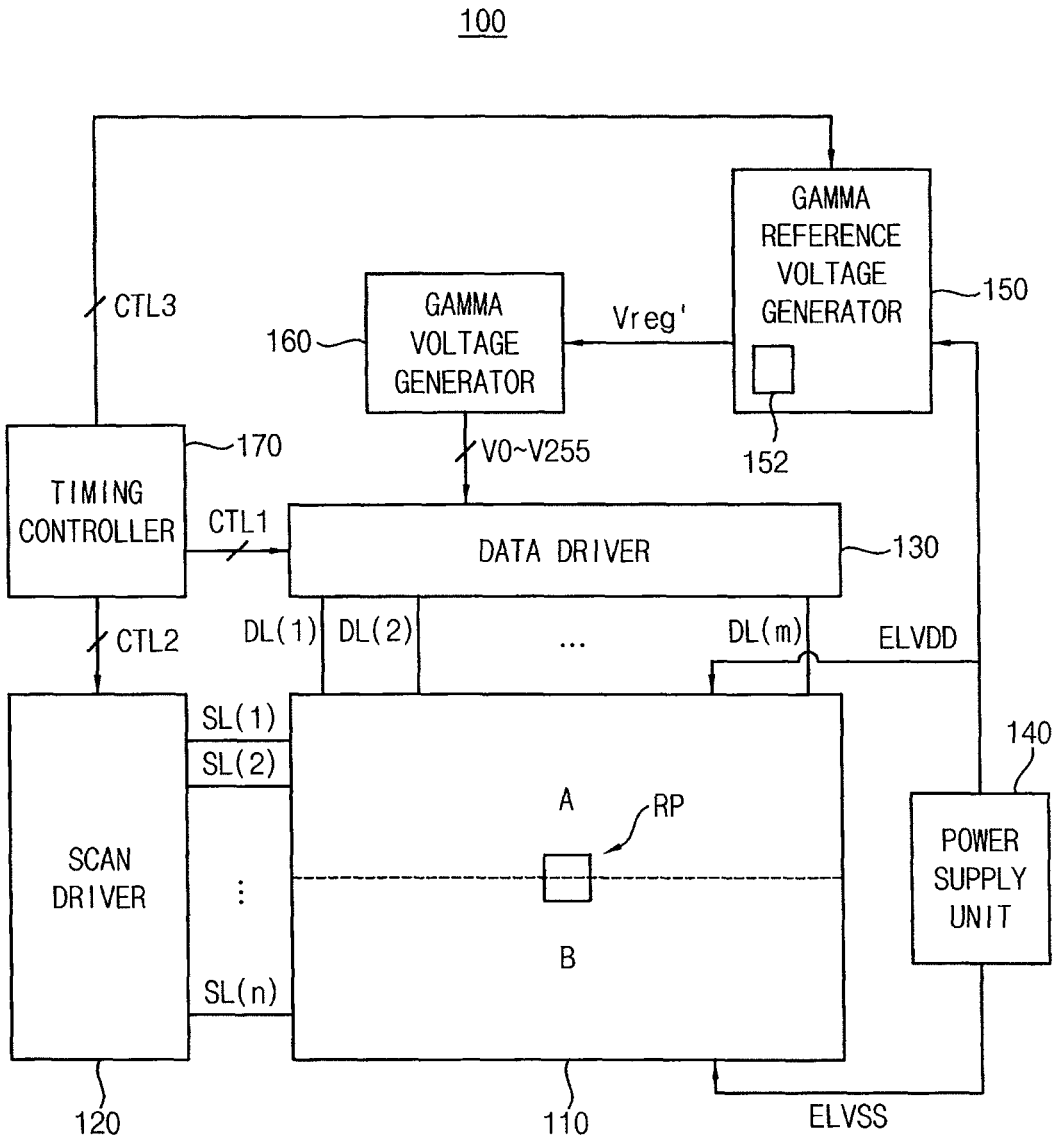
FIG. 1 is a block diagram of an OLED display according to example embodiments.

FIG. 1 is a block diagram of an organic light-emitting diode (OLED) display according to example embodiments.

Referring to FIG. 1, the OLED display 100 includes a display panel 110, a scan driver 120, a data driver 130, a power supply unit 140, a gamma reference voltage generator 150, a gamma voltage generator 160, and a timing controller 170. In some embodiments, as illustrated in FIG. 1, the gamma reference voltage generator 150 and the gamma voltage generator 160 are external to the timing control unit 170 and the data driver 130. In some embodiments, the gamma reference voltage generator 150 and the gamma voltage generator 160 are included in the data driver 130. In some embodiments, the gamma reference voltage generator 150 is included in the power supply unit 140.

The display panel 110 can include a plurality of pixels. The display panel 110 can be coupled to the scan driver 120 via a plurality of scan lines SL(1) through SL(n), and can be coupled to the data driver 130 via a plurality of data lines DL(1) through DL(m). Here, the pixels can be arranged at locations corresponding to crossing points of the scan lines SL(1) through SL(n) and the data lines DL(1) through DL(m). Thus, the display panel 110 can include n*m pixels.

The scan driver 120 can provide a scan signal to the display panel 110 via the scan lines SL(1) through SL(n).

The data driver 130 can provide a data signal to the display panel 110 via the data lines DL(1) through DL(m). The data driver 130 can generate the data signal according to an image data based at least in part on a gamma reference voltage. The data driver 130 can generate the data signal corresponding to gamma voltages.

The power supply unit 140 can provide a first power voltage ELVDD and a second power voltage ELVSS to the display panel 110. The first power voltage ELVDD can be a high power voltage and the second power voltage ELVSS can be a low power voltage.

The gamma reference voltage generator 150 can generate a compensation gamma reference voltage Vreg' compensating the gamma reference voltage. In some embodiments, the gamma reference voltage generator 150 generates N (N is a positive integer) gamma reference voltages and N compensation gamma reference voltages each having a different voltage level. For example, the gamma reference voltage generator outputs a first compensation gamma reference voltage of a first gamma reference voltage to an Nth compensation gamma reference voltage of an Nth gamma reference voltage. The gamma reference voltage can be predetermined based at least in part on the first power voltage ELVDD.

The gamma reference voltage generator 150 can output the compensation gamma reference voltage Vreg' of the gamma reference voltage to change to a second voltage level from a first voltage level within a frame based on a detected voltage level of the first power voltage ELVDD detected at the display panel 110. The gamma reference voltage and the compensation gamma reference voltage Vreg' can be a driving voltage applied to the gamma voltage generator to generate gamma voltages. In some embodiments, the gamma reference voltage generator 150 outputs the first to Nth compensation gamma reference voltages based at least in part on a voltage difference between the detected voltage level and a reference voltage. The gamma reference voltage generator 150 can determine the first voltage level of the compensation gamma reference voltage Vreg' according to a luminance level of the display panel 110 that corresponds to a dimming level of the display panel 110. For example, the gamma reference voltage generator 150 determines the first voltage level of the first and second compensation gamma reference voltages according to the luminance level of the display panel 110. In some embodiments, the first voltage level is a maximum value of the compensation gamma reference voltage Vreg' of the frame, and the second voltage level is a minimum value of the compensation gamma reference voltage Vreg' of the frame.

In some embodiments, the reference voltage is the detected voltage level of the first power voltage ELVDD that is detected at the detection point RP when the display panel 110 emits light to have a maximum luminance level and a maximum gray level. For example, the maximum luminance level corresponds to about 300 cd/m$^2$, and the maximum gray level corresponds to gray level 255 in about 300 cd/m$^2$ (i.e., the display panel 110 emits full-white light). In some embodiments, the reference voltage is the detected voltage level of the first power voltage ELVDD that is detected at the detection point RP when the display panel 110 emits light as full-white.

The dimming level means the luminance of an image displayed at the display panel 110. Thus, when the dimming level is adjusted while the same image is displayed at the display panel 100, the luminance level of the image is adjusted corresponding to the dimming level. In some embodiments, a user selects (or adjusts) an arbitrary dimming level (i.e., the luminance level). In some embodiments, the luminance level (i.e., the dimming level) is adjusted by adjusting gamma brightness or adjusting emission duty ratio. The first voltage level of the compensation gamma reference voltage Vreg' is determined according to the dimming level (i.e., the luminance level of the display panel 110).

When the luminance level is maintained to have a substantially uniform level, the image displayed in the display panel 110 is changed by changing the image data. A voltage drop of the first power voltage ELVDD in the display panel 110 can vary according to changes of an average of gray level of the image displayed in the display panel 110. That is, an emission current and the voltage drop of the first power voltage ELVDD can increase as the gray level (or the average gray level) of the image increases. The gamma reference voltage generator 150 can output the compensation gamma reference voltage Vreg' reflecting the change of the average gray level. For example, the second voltage level (or the minimum value of the compensation gamma reference voltage Vreg') can be adjusted according to the change of the average gray level. Thus, the data driver 130 can receive the gamma voltage compensated based on the compensation gamma reference voltage Vreg', and apply the data signal to the gamma voltage to the pixels, so that a luminance deviation by the voltage drop by the change of the average gray level can be improved (or removed).

The gamma reference voltage generator 150 can include a luminance level detection unit, a lookup table, a detection unit, and a gamma reference voltage compensation unit.

The gamma voltage generator 160 can generate a plurality of gamma voltages based at least in part on the compensation gamma reference voltage Vreg'. The gamma voltage generator 160 can output the gamma voltages by dividing the compensation gamma reference voltage Vreg'. The gamma voltages can be applied to the data driver 130. Each gamma voltage can correspond to the data signal/

The timing controller 170 can control the scan driver 120, the data driver 130, and the gamma reference voltage generator 150 based at least in part on first through third control signals CTL1, CTL2, and CTL3. The timing controller 170 can receive an input control signal and an image data signal from an image source such as an external graphic apparatus. The input control signal can include a main clock signal, a vertical synchronizing signal, a horizontal synchronizing signal, and a data enable signal. The timing controller can control the power supply unit 140 based at least in part on a fourth control signal CTL4.

In some embodiments, the OLED display 100 further includes an emission control unit that outputs an emission control signal for controlling light emitting operations of the pixels included in the display panel 110.

Figure 2A:
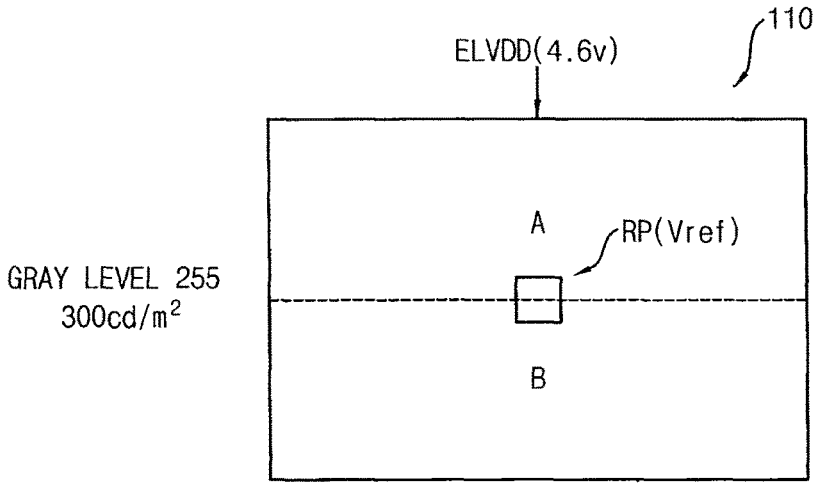
FIG. 2A is a diagram illustrating an example of determining a reference voltage in the OLED display of FIG. 1.
Figure 2B:
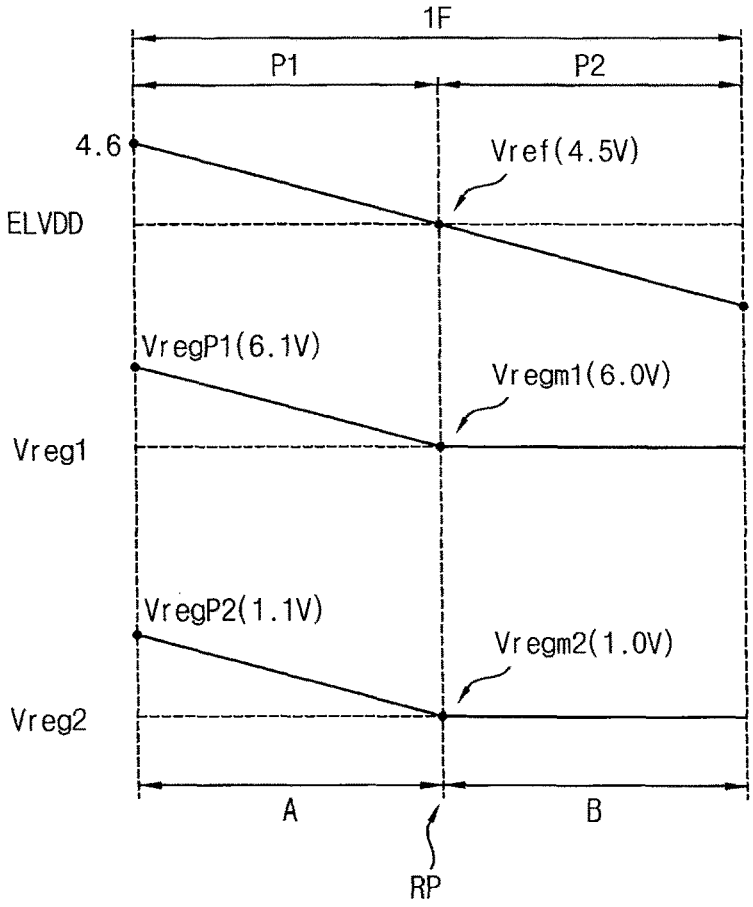
FIG. 2B is a diagram illustrating an example of generating a first gamma reference voltage and a second gamma reference voltage based on the reference voltage of FIG. 2A.

FIG. 2A is a diagram illustrating an example of determining a reference voltage in the OLED display 100 of FIG. 1. FIG. 2B is a diagram illustrating an example of generating a first gamma reference voltage and a second gamma reference voltage based on the reference voltage of FIG. 2A.

Referring to FIGS. 1, 2A, and 2B, the OLED display 100 determines a reference voltage Vref, a first gamma reference voltage Vreg1, and a second gamma reference voltage Vreg2. A first compensation gamma reference voltage can correspond to a value that a voltage difference between the reference voltage Vref, and a detected voltage level of the first power voltage ELVDD is applied to the first gamma reference voltage Vreg1. A second compensation gamma reference voltage can correspond to a value that the voltage difference is applied to the second gamma reference voltage Vreg2.

The reference voltage Vref is used in the gamma reference voltage generator 150 to calculate a voltage drop of the first power voltage ELVDD at a detection point RP.

The reference voltage Vref can be the detected voltage level of the first power voltage ELVDD that is detected at the detection point RP when the display panel 110 emits light to have a maximum luminance level and a maximum gray level. As illustrated in FIG. 2A, the maximum luminance level corresponds to about 300 cd/m$^2$, and the maximum gray level corresponds to gray level 255 in about 300 cd/m$^2$ (i.e., the display panel 110 emits full-white light). That is, the reference voltage Vref can be the detected voltage level at the detection point RP when the voltage drop of the first power voltage ELVDD is the greatest. For example, if the first power voltage ELVDD output from the power supply unit 140 (or, the first power voltage ELVDD applied to the pixels arranged in a first row of the display panel 110) is about 4.6V, the reference voltage is set (or detected) at about 4.5V, and the amount of voltage drop is about 0.1V. In this, the voltage drop is a maximum value so that the reference voltage Vref is a minimum value of the detected voltage level at the detection point RP. Thus, the detected voltage level is substantially equal to the reference voltage Vref or higher than the reference voltage Vref.

In some embodiments, the detection point RP corresponds to a portion of a center line of the display panel, the center line being substantially parallel to the scan line. The display panel 110 can be divided to a first area A and a second area B by the detection point RP. The first area A can be closer to the data driver 130 than the detection point RP, and the second area B can be a remaining area of the display panel 110 adjacent to the first area A. When the display panel emit light to high gray level and/or high luminance, the luminance deviation in the first area A by the voltage drop of the first power voltage ELVDD can be greater than the luminance deviation in the second area B by the voltage drop of the first power voltage ELVDD. Thus, voltage levels of the first and second gamma reference voltages Vreg1 and Vreg2 can be changed within one frame.

As illustrated in FIG. 2B, the first and second gamma reference voltages Vreg1 and Vreg2 are set based at least in part on the voltage drop of the first power voltage ELVDD. The data signal generated based at least in part on the first and second gamma reference voltages Vreg1 and Vreg2 can be applied to the first area A of the display panel 110 during a first duration P1 of one frame 1F, and can be applied to the second area B of the display panel 110 during a second duration P2 of the frame 1F. Here, the first power voltage ELVDD can substantially linearly decrease in the display panel 110 as a position of the display panel is farther from the data driver 140. The first duration P1 can correspond to a duration in which the data signal is applied to a first area A. The second duration P2 can correspond to a duration in which the data signal is applied to a second area B.

In the first area A, the luminance deviation between a certain row line and another row line is relatively large. Therefore, the first and second gamma reference voltages Vreg1 and Vreg2 substantially linearly decrease during the first duration P1. In the second area B, the luminance deviation between a certain row line and another row line is substantially negligible. Thus, the first and second gamma reference voltages Vreg1 and Vreg2 have a certain substantially uniform voltage level during the second duration P2.

The first gamma reference voltage Vreg1 for generating the data signal applied to a pixel arranged at the detection point RP can be set based at least in part on the reference voltage Vref. A voltage level of the first gamma reference voltage Vreg1 related to the data signal applied to the pixel arranged at the detection point RP can correspond to a minimum value Vregm1 of the first gamma reference voltage Vreg1. For example, when the reference voltage Vref is about 4.5V, the minimum value Vregm1 is determined to be about 6.0V. The first gamma reference voltage Vreg1 can be output to have the minimum value Vregm1 during the second duration P2.

The first gamma reference voltage Vreg1 for generating the data signal applied to a pixel arranged at the first row of the display panel 110 can be set based at least in part on the voltage drop of the first power voltage ELVDD. The voltage level of the first gamma reference voltage Vreg1 related to the data signal applied to the pixel arranged at the first row of the display panel 110 can correspond to a maximum value VregP1 (i.e., a peak value) of the first gamma reference voltage Vreg1. For example, when the reference voltage Vref is about 4.5V and the voltage drop is about 0.1V, the maximum value of the first gamma reference voltage Vreg1 is determined to be about 6.1V. The first gamma reference voltage Vreg1 can be output to substantially linearly change to the minimum value Vregm1 from the maximum value VregP1 during the first duration P1.

Similarly, the second gamma reference voltage Vreg2 can be output to substantially linearly change to a minimum value Vregm2 from a maximum value VregP2 during the first duration P1. The second gamma reference voltage Vreg2 can be output to have the minimum value Vregm2 during the second duration P2. For example, the minimum value Vregm2 is about 1.0V, and the maximum value VregP2 is about 1.1V based at least in part on the voltage drop of the first power voltage ELVDD at the detection point RP.

The gamma reference voltage generator 150 can generate first and second compensation gamma reference voltages Vreg1' and Vreg2' based at least in part on the reference voltage Vref and the first and second gamma reference voltages Vreg1 and Vreg2.

However, these are examples, and the number of gamma reference voltages (and the number of compensation gamma reference voltages), the number of areas, and positions of the detection point are not limited thereto.

Figure 3:
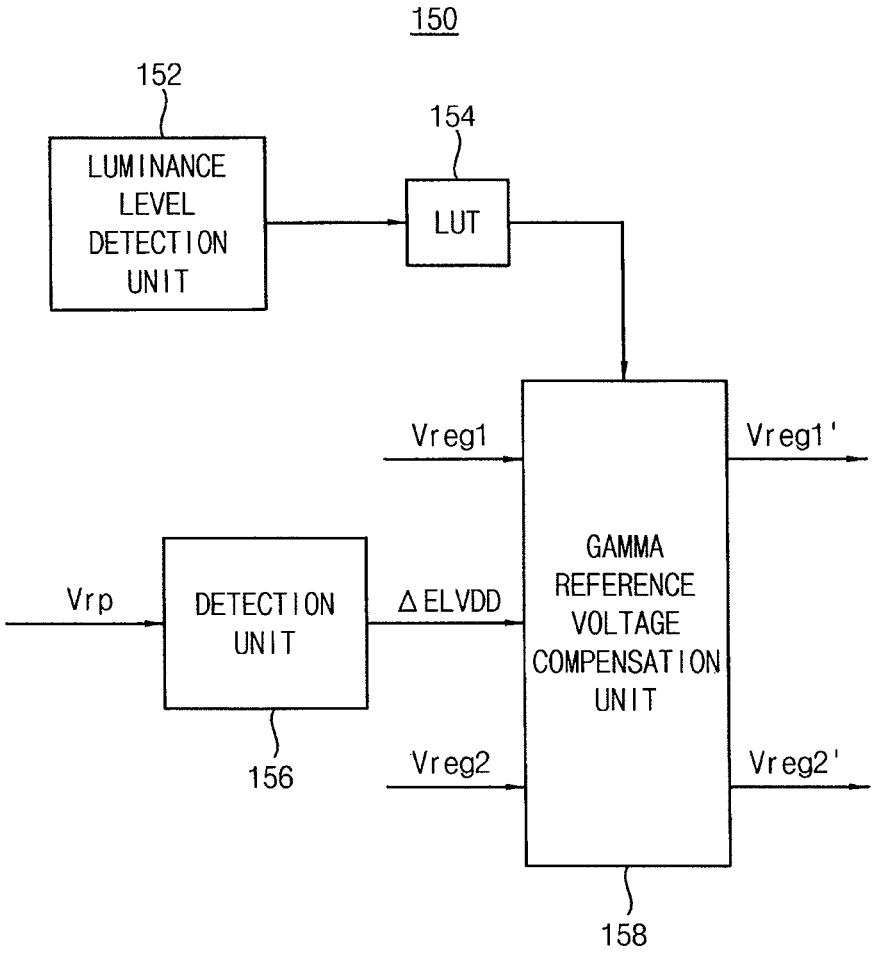
FIG. 3 is a block diagram illustrating a gamma reference voltage generator included in the OLED display of FIG. 1.
Figure 4:
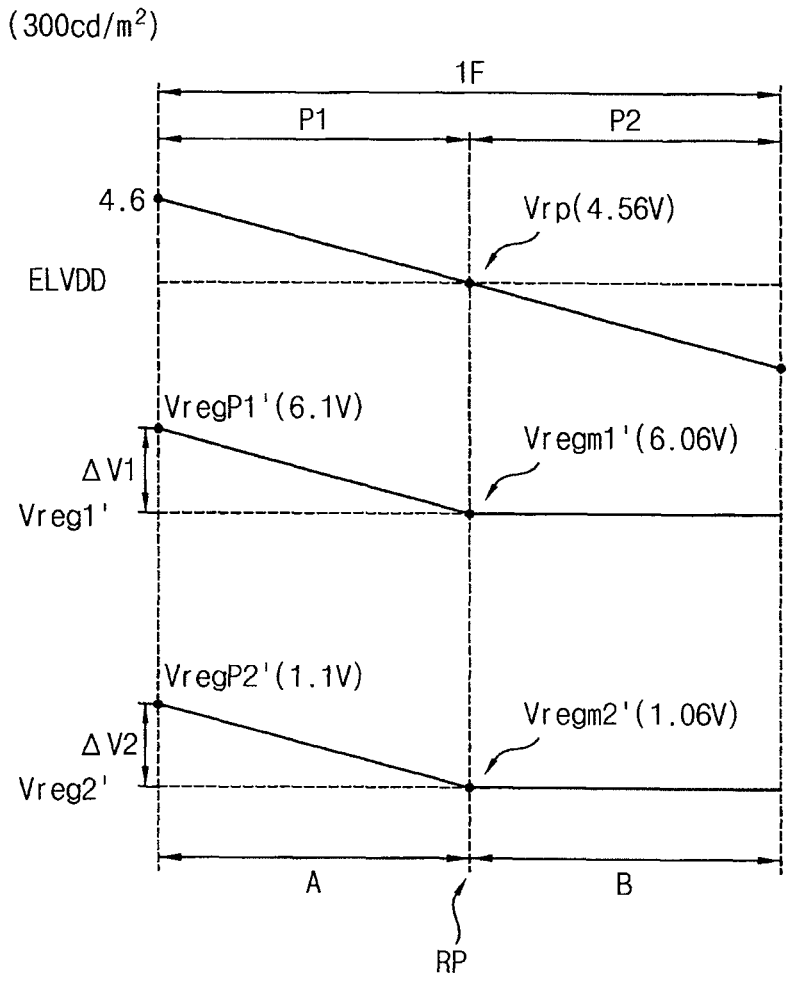
FIG. 4 is a diagram illustrating an example of a first compensation gamma reference voltage and a second compensation gamma reference voltage being output from the gamma reference voltage generator of FIG. 3.

FIG. 3 is a block diagram illustrating a gamma reference voltage generator included in the OLED display 100 of FIG. 1. FIG. 4 is a diagram illustrating an example of a first compensation gamma reference voltage and a second compensation gamma reference voltage being output from the gamma reference voltage generator 150 of FIG. 3.

Referring to FIGS. 1, 3 and 4, the gamma reference voltage generator 150 includes a luminance level detection unit 152, a lookup table (LUT) 154, a detection unit 156, and a gamma reference voltage compensation unit 158.

The luminance level detection unit 152 can detect the luminance level of the display panel 110. In some embodiments, the luminance level detection unit 152 receives an image data from the timing controller 170, and determines the luminance level (or a dimming level) of an image displayed in the display panel 110 based at least in part on the image data.

The LUT 154 can have the first voltage level of the compensation gamma reference voltage Vreg' corresponding to the luminance level. In some embodiments, the LUT 154 has maximum values VregP1' of the first compensation gamma reference voltage Vreg1' corresponding to the respective luminance levels and maximum values VregP2' corresponding to the respective luminance levels. For example, the LUT 154 is expressed as in the following Table 1.

TABLE 1

| Luminance level(cd/m$^2$) | VregP1'(V) | VregP2'(V) |
|---|---|---|
| 0 | 6.000 | 1.000 |
| . | . | . |
| . | . | . |
| . | . | . |
| 200 | 6.060 | 1.060 |
| . | . | . |
| . | . | . |
| . | . | . |
| 300 | 6.100 | 6.100 |

However, this is only an example, and the maximum levels VregP1' and VregP2' corresponding to the respective luminance levels are not limited thereto.

The LUT 154 can output the maximum level VregP1' and the maximum value VregP2' corresponding to the luminance level detected at the luminance level detection unit 152 to the gamma reference voltage compensation unit 158.

The detection unit 156 can calculate a voltage difference ΔELVDD between the detected voltage level Vrp of the first power voltage ELVDD at the detection point RP of the display panel and the reference voltage Vref.

Although it is not illustrated, a reference voltage generating unit generating the reference voltage Vref can be included in the detection unit 156. For example, if the reference voltage is about 4.5V and the detected voltage level Vrp is about 4.55V, the voltage difference ΔELVDD is about 0.05V. In some embodiments, the voltage difference ΔELVDD is calculated by an equation of ΔELVDD=Vrp−Vref.

In some embodiments, the detection unit 156 converts the detected voltage level Vrp to a digital value via an analog-digital converter, and outputs the voltage difference ΔELVDD comparing the digital value with a digital value of the reference voltage Vref.

The gamma reference voltage compensation unit 158 can determine the first voltage level of the compensation gamma reference voltage Vreg' referring to the LUT 154, and determine the second voltage level of the compensation gamma reference voltage Vreg' based at least in part on the voltage difference ΔELVDD. In some embodiments, the first voltage level is a maximum value of the compensation gamma reference voltage of the frame, and the second voltage level is a minimum value of the compensation gamma reference voltage of the frame. In some embodiments, the gamma reference voltage compensation unit 158 generates the second voltage level (i.e., the minimum level Vregm1') of the first compensation gamma reference voltage Vreg1' by applying the voltage difference ΔELVDD to the minimum value Vregm1 of the first gamma reference voltage Vreg1, and generates the second voltage level (i.e., the minimum level Vregm2') of the second compensation gamma reference voltage Vreg2' by applying the voltage difference ΔELVDD to the minimum value Vregm2 of the second gamma reference voltage Vreg2.

In some embodiments, the gamma reference voltage compensation unit 158 determines the second voltage level of the compensation gamma reference voltage Vreg' by adding the voltage difference ΔELVDD to the minimum value of the gamma reference voltage of the frame. For example, the gamma reference voltage compensation unit 158 determines the minimum value Vregm1' by adding the voltage difference ΔELVDD to the minimum value Vregm1 of the first gamma reference voltage Vreg1. The gamma reference voltage compensation unit 158 can determine the minimum value Vregm2' by adding the voltage difference ΔELVDD to the minimum value Vregm2 of the second gamma reference voltage Vreg2. For example, the second voltage level (e.g., the minimum value Vregm1') of the first compensation gamma reference voltage Vreg1' is calculated by an equation of Vregm1'=Vrefm1+ΔELVDD, and the second voltage level (e.g., the minimum value Vregm2') of the second compensation gamma reference voltage Vreg2' is calculated by an equation of Vregm2'=Vrefm2+ΔELVDD.

In some embodiments, a gamma reference voltage offset matched to the voltage difference ΔELVDD of the first power voltage ELVDD is added to and subtracted from the first gamma reference voltage Vreg1 and the second gamma reference voltage Vreg2. The gamma reference voltage offset can be matched in accordance with the voltage difference ΔELVDD to be realized by a table. The gamma reference voltage offset can be drawn by an algorithm and can be drawn by synthesizing a repetitive experiment result value. However, a method of applying the voltage difference ΔELVDD to the first gamma reference voltage Vreg1 and the second gamma reference voltage Vreg2 is not limited to the above. Various mathematical and experimental methods can be applied.

When the luminance level is maintained to have uniform level, the gamma reference voltage compensation unit 158 can set the maximum level VregP1' and the maximum level VregP2' referring to the LUT 154. Thus, when the luminance level is maintained to have uniform level, even though the voltage difference ΔELVDD is changed by the change of average gray level of the image data, the maximum level VregP1' and the maximum level VregP2' are not changed.

As illustrated in FIG. 4, in some embodiments, the OLED display 100 emitting light of about 300 cd/m$^2$ luminance level (or dimming level) changes the average gray levels of images (i.e., change display images). The voltage drop of the first power voltage ELVDD can increase as the gray level (or the average gray level) of the image increases. (i.e., the detected voltage level Vrp decreases.)

The gamma reference voltage compensation unit 158 can determine the maximum value VregP1' and the maximum value VregP2' corresponding the about 300 cd/m$^2$ luminance level by referring to the LUT 154. For example, as illustrated in FIG. 4, the first compensation gamma reference voltage Vreg1' be about 6.1V, and the maximum value VregP2' can be about 1.1V.

The gamma reference voltage compensation unit 158 can output the compensation gamma reference voltage Vreg' to substantially linearly decrease from the first voltage level to the second voltage level during the first duration P1. In some embodiments, the gamma reference voltage compensation unit 158 outputs the first compensation gamma reference voltage Vreg1' to substantially linearly decrease from the maximum value VregP1' to the minimum value Vregm1', and outputs the second compensation gamma reference voltage Vreg2' to substantially linearly decrease from the maximum value VregP2' to the minimum value Vregm2' during the first duration P1.

The detection unit 156 can calculate the voltage difference ΔELVDD between the detected voltage level Vrp of the first power voltage ELVDD at the detection point RP of the display panel and the reference voltage Vref. For example, if the reference voltage is about 4.5V and the detected voltage level Vrp is about 4.56V, the voltage difference ΔELVDD is about 0.06V.

The gamma reference voltage compensation unit 158 can output the second voltage level of the compensation gamma reference voltage Vreg' during the second duration P2. In some embodiments, the gamma reference voltage compensation unit 158 outputs the minimum value Vregm1' and the minimum value Vregm2' during the second duration P2. If the minimum value Vregm1 is about 6.0V and the minimum value Vregm2 is about 1.0V, the minimum value Vregm1' can be determined to about 6.06V and the minimum value Vregm2' can be determined to about 1.06V.

The data signal generated based on the first and second gamma reference voltages Vreg1 and Vreg2 can be applied to the first area A of the display panel 110 during a first duration P1 of one frame 1F, and can be applied to the second area B of the display panel 110 during a second duration P2 of the frame 1F. Here, the first power voltage ELVDD can substantially linearly decrease in the display panel 110 as a position of the display panel is farther from the data driver 130. The first duration P1 can correspond to a duration in which the data signal is applied to a first area A. The second duration P2 can correspond to a duration in which the data signal is applied to a second area B.

The voltage drop of the first power voltage ELVDD in the display panel 110 can decrease as the average gray level decreases such that amount of current applied to the pixels decrease. Thus, the detected voltage level Vrp at the detection point RP can increase. As the detected voltage level Vrp increases, the voltage difference ΔELVDD increases and the minimum values Vregm1' and Vregm2' increase. Therefore, as the average gray level of the display panel 110 decreases (i.e., low gray level is displayed), a voltage difference ΔV1 and ΔV2 between the maximum value VregP1' and VregP2' and the minimum value Vregm1' and Vregm2' can decrease.

As a result, when the display panel 110 displays an image to have high gray level (i.e., the voltage drop of the first power voltage ELVDD is large), the gamma reference voltage generator 150 increases the voltage difference ΔV1 and ΔV2 between the maximum value VregP1' and VregP2' and the minimum value and Vregm2' such that the deviation of the luminance between the first area A and the second area B can be removed (can be improved). In contrast, when the display panel 110 displays an image to have low gray level (i.e., the voltage drop of the first power voltage ELVDD is very small), the voltage difference ΔV1 and ΔV2 between the maximum value VregP1' and VregP2' and the minimum value Vregm1' and Vregm2' can decrease such that the deviation of the luminance between the first area A and the second area B can be removed (can be improved).

However, above described operation is not limited thereto. For example, when an average gray level is maintained to have a substantially uniform level and the luminance level is changed, the voltage difference ΔV1 and ΔV2 between the maximum value VregP1' and VregP2' and the minimum value Vregm1' and Vregm2' is adjusted based at least in part on the change of the luminance level by adjusting the minimum value Vregm1' and Vregm2'.

As described above, the OLED display 100 according to example embodiments independently determines the first and second voltage levels of the compensation gamma reference voltage. That is, the OLED display 100 according to example embodiments determines the first voltage level (e.g., the maximum value) of the compensation gamma reference voltage Vreg' referring to the LUT 154 and only adjust the second voltage level (e.g., the minimum level) of the compensation gamma reference voltage Vreg' based at least in part on the voltage difference ΔELVDD (i.e., based on change of the average gray level) when the luminance level is maintained to have a substantially uniform level. In some embodiments, the voltage difference between the first and second voltage levels of the compensation gamma reference voltage Vreg' is adjusted according to the change of the average gray level. Thus, the optimal gamma voltage (or data voltage) can be selected based at least in part on the gray level, and the deviation of luminance between internal areas of the display panel 110 can be effectively removed.

Figure 5:
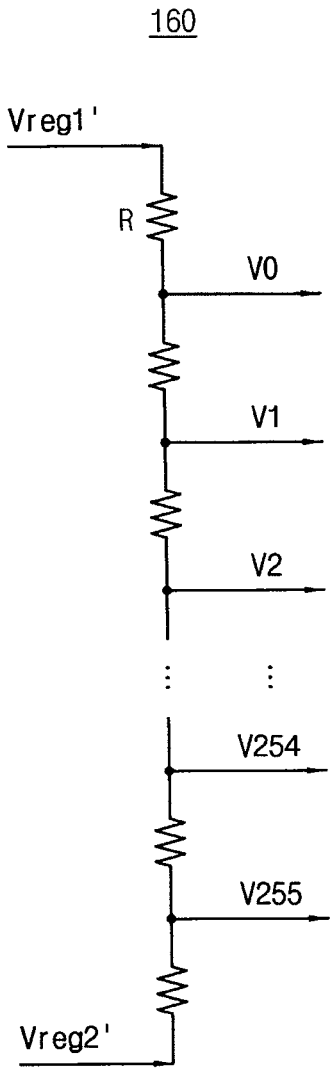
FIG. 5 is a diagram illustrating an example of a gamma voltage generator included in the OLED display of FIG. 1.

FIG. 5 is a diagram illustrating an example of a gamma voltage generator included in the OLED display 100 of FIG. 1.

Referring to FIGS. 3 to 5, the gamma voltage generator 160 includes a plurality of serially connected resistors R and divides the first and second compensation gamma reference voltages Vreg1' and Vreg2' through the resistors R to generate the gamma voltages V0 through V255.

The gamma voltages V0 through V255 can be applied to the data driver 130. The gamma voltage generator 160 can generate different gamma voltages for the data signals. In addition, the number of the gamma voltages V0 through V255 can vary in accordance with the structure of a resistor string and is not limited to 256.

In addition, in FIG. 5, the first compensation gamma reference voltage Vreg1' is illustrated as having a different value from the first gamma voltage V0. However, the resistor string can be configured such that first compensation gamma reference voltage Vreg1' can be directly used as the first gamma voltage V0. The second compensation gamma reference voltage Vreg2' is illustrated as having a different value from the final gamma voltage V255. However, the resistor string can be configured such that the second compensation gamma reference voltage Vreg2' can be directly used as the final gamma voltage V255. Further, at least one compensation gamma reference voltage having a voltage level between the first and second compensation gamma reference voltages Vreg1' and Vreg2' can be generated in the gamma reference voltage generator 150, and be applied to the gamma voltage generator 160.

In some embodiments, the gamma voltage generator is included in the data driver 130.

The data driver 130 can receive the gamma voltages V0 through V255 and generate the data signals (i.e. data voltages) corresponding to the respective gamma voltages V0 through V255.

Figure 6:
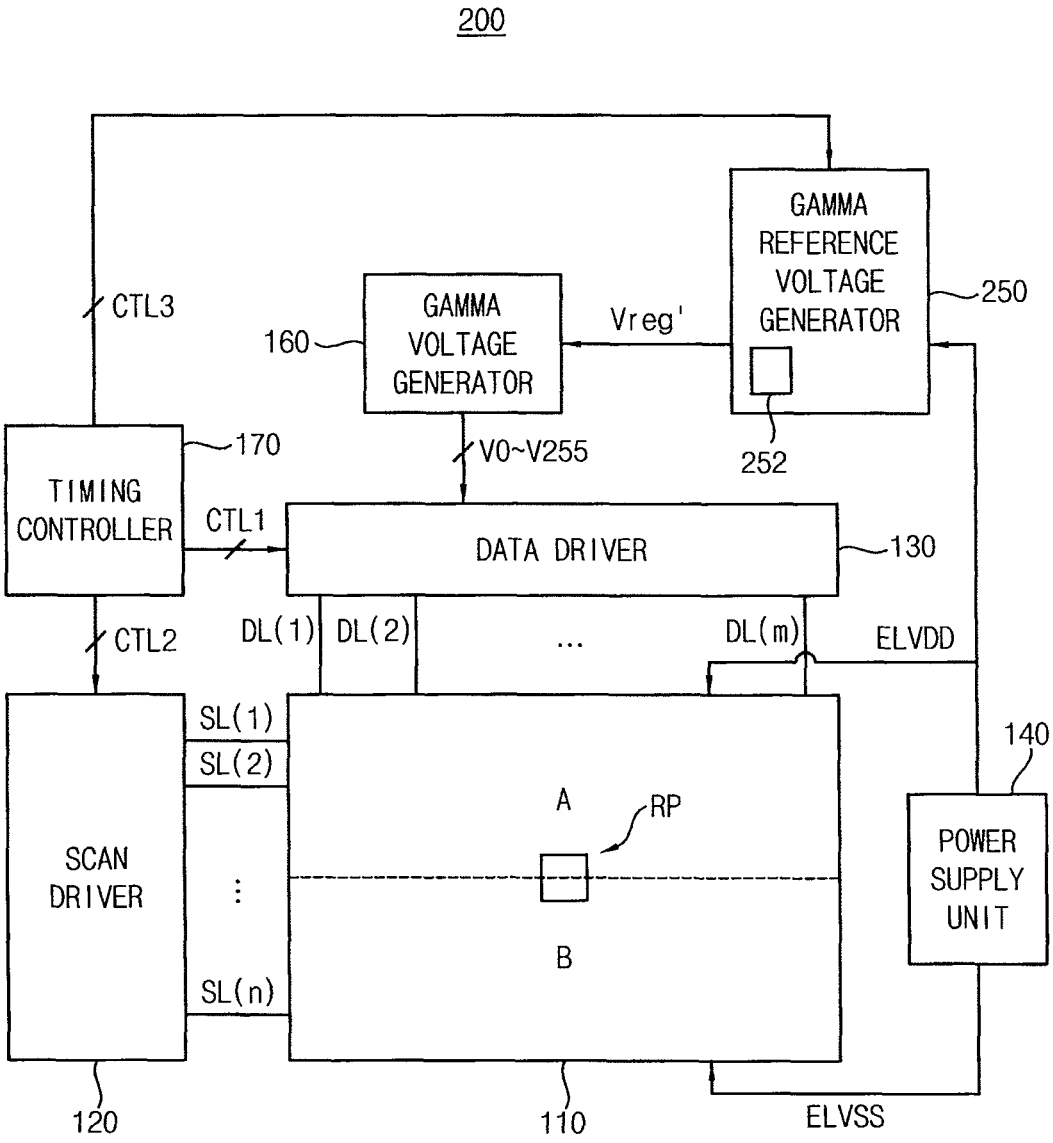
FIG. 6 is a block diagram of an OLED display according to example embodiments.

FIG. 6 is a block diagram of an OLED display according to example embodiments.

In FIG. 6, like reference numerals are used to designate elements of the OLED display 100 in FIG. 1, and detailed description of these elements can be omitted. The OLED display 200 of FIG. 6 can be substantially the same as or similar to the OLED display 100 of FIG. 1 except for the gamma reference voltage generator 250. Like reference numerals are used to represent like elements.

Referring to FIG. 6, the OLED display 200 can include a display panel 110, a scan driver 120, a data driver 130, a power supply unit 140, a gamma reference voltage generator 250, a gamma voltage generator 160, and a timing controller 170.

The timing controller 170 can control the scan driver 120, the data driver 130, and the gamma reference voltage generator 250 based at least in part on first through third control signals CTL1, CTL2, and CTL3.

The gamma reference voltage generator 250 can generate a compensation gamma reference voltage Vreg' compensating the gamma reference voltage. In some embodiments, the gamma reference voltage generator 250 can generate N (N is a positive integer) gamma reference voltages and N compensation gamma reference voltages each having different voltage level. The gamma reference voltage can be predetermined based on the first power voltage ELVDD.

The gamma reference voltage generator 250 can output the compensation gamma reference voltage Vreg' of the gamma reference voltage to change to a second voltage level from a first voltage level within a frame based at least in part on a detected voltage level of the first power voltage ELVDD detected at the display panel 110. In some embodiments, the gamma reference voltage generator 250 outputs a first compensation gamma reference voltage of a first gamma reference voltage and a second compensation gamma reference voltage of a second gamma reference voltage. The second gamma reference voltage can be less than the first gamma reference voltage. The gamma reference voltage generator 250 can determine the second voltage level of the compensation gamma reference voltage Vreg' based at least in part on an average gray level of the display panel 110. In some embodiments, the average gray level means an average of gray levels of one frame image data. For example, the gamma reference voltage generator 250 determines the second voltage level of the first and second compensation gamma reference voltages based at least in part on the average gray level of the display panel 110. In some embodiments, the first voltage level is a maximum value of the compensation gamma reference voltage Vreg' of the frame, and the second voltage level is a minimum value of the compensation gamma reference voltage Vreg' of the frame.

The gray level and the average gray level can depend on the image (i.e., the image data) displayed in the display panel 110. The gray level can be determined by a plurality of gamma voltages. For example, 256 gamma voltages are generated by a resistor string in the gamma voltage generator 160, and the gray level is realized by the gamma voltages.

When the average gray level is maintained to have a substantially uniform level, a luminance of the same image displayed in the display panel 110 can be changed by adjusting dimming levels. A voltage drop of the first power voltage ELVDD in the display panel 110 can vary based at least in part on changes of a luminance level (or a dimming level) of the image displayed in the display panel 110. That is, an emission current and the voltage drop of the first power voltage ELVDD can increase as the luminance level (or the dimming level) of the image increases. The gamma reference voltage generator 250 can output the compensation gamma reference voltage Vreg' reflecting the change of the dimming level. Thus, the data driver 130 can receive the gamma voltage compensated based on the compensation gamma reference voltage Vreg', and apply the data signal to the gamma voltage to the pixels, so that a luminance deviation by the voltage drop by the change of the dimming level can be improved (or removed).

The gamma reference voltage generator 150 can include a gray level detection unit, a lookup table, a detection unit, and a gamma reference voltage compensation unit.

Figure 7:
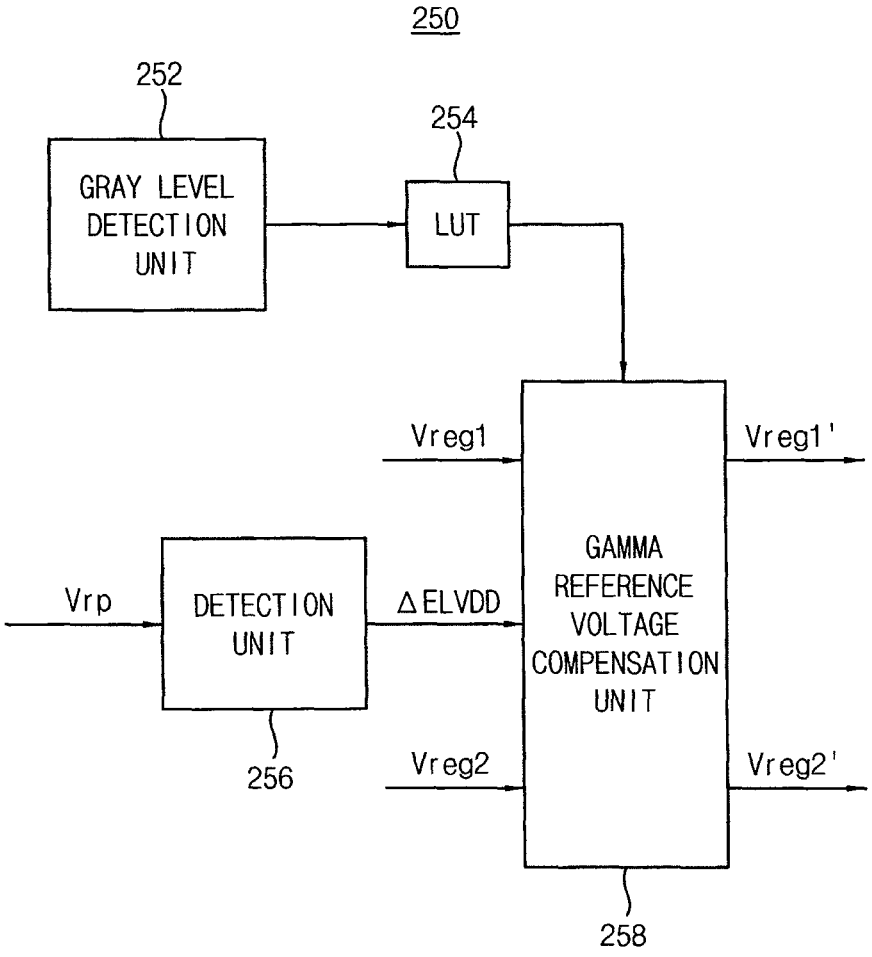
FIG. 7 is a block diagram illustrating a gamma reference voltage generator included in the OLED display of FIG. 6.
Figure 8:
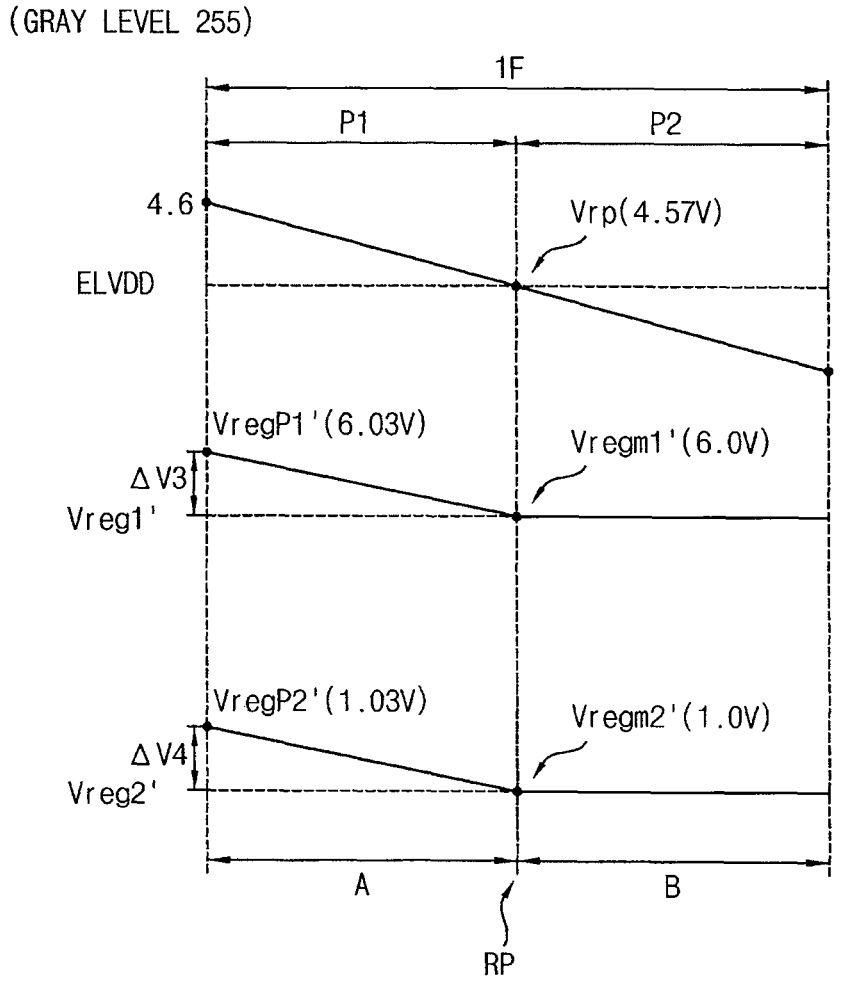
FIG. 8 is a diagram illustrating an example of a first compensation gamma reference voltage and a second compensation gamma reference voltage being output from the gamma reference voltage generator of FIG. 7.

FIG. 7 is a block diagram illustrating a gamma reference voltage generator included in the OLED display 200 of FIG. 6. FIG. 8 is a diagram illustrating an example of a first compensation gamma reference voltage and a second compensation gamma reference voltage being output from the gamma reference voltage generator 250 of FIG. 7.

Referring to FIGS. 7 and 8, the gamma reference voltage generator 250 includes a gray level detection unit 252, a lookup table (LUT) 254, a detection unit 256, and a gamma reference voltage compensation unit 258.

The gray level detection unit 252 can detect the average gray level of the display panel 110 based at least in part on an image data. In some embodiments, the luminance level detection unit 252 receives the image data from the timing controller 170, and determines the average gray level of an image displayed in the display panel 110 based on the image data. The gray level detection unit 252 can include an average calculation unit to calculate the average gray level of the image data.

The LUT 254 can have the second voltage level of the compensation gamma reference voltage Vreg' (i.e., the minimum value of the compensation gamma reference voltage) corresponding to the luminance level. In some embodiments, the LUT 254 has minimum values Vregm1' of the first compensation gamma reference voltage Vreg1' corresponding to the respective average gray level and minimum values Vregm2' of the second compensation gamma reference voltage Vreg2' corresponding to the respective average gray levels. For example, the LUT 254 is expressed as in the following Table 2.

TABLE 2

| Average gray level(cd/m2) | Vregm1'(V) | Vregm2'(V)) |
|---|---|---|
| 0 | 6.100 | 1.100 |
| . | . | . |
| . | . | . |
| . | . | . |
| 100 | 6.060 | 1.060 |
| . | . | . |
| . | . | . |
| . | . | . |
| 255 | 6.000 | 6.000 |

However, this is only an example, and the minimum levels VregP1' and VregP2' corresponding to the respective average gray levels are not limited thereto.

The LUT 254 can output the minimum level Vregm1' and the minimum value Vregm2' corresponding to the average gray level detected at the gray level detection unit 252 to the gamma reference voltage compensation unit 258.

The detection unit 256 can calculate a voltage difference ΔELVDD between the detected voltage level Vrp of the first power voltage ELVDD at the detection point RP of the display panel and the reference voltage Vref.

In some embodiments, the detection point RP corresponds to a portion of a center line of the display panel, the center line being substantially parallel to the scan line. The display panel 110 can be divided to a first area A and a second area B by the detection point RP. The first area A can be closer to the data driver 130 than the detection point RP, and the second area B can be a remaining area of the display panel 110 adjacent to the first area A. When the display panel emit light to high gray level and/or high luminance, the luminance deviation in the first area A by the voltage drop of the first power voltage ELVDD can be greater than the luminance deviation in the second area B by the voltage drop of the first power voltage ELVDD. Thus, voltage levels of the first and second gamma reference voltages Vreg1 and Vreg2 can be changed within one frame.

The gamma reference voltage compensation unit 258 can determine the minimum value Vregm1' and the minimum value Vregm2' by referring to the LUT 254.

The gamma reference voltage compensation unit 258 can generate the first voltage level (i.e., a maximum level VregP1') of the first compensation gamma reference voltage Vreg1' by applying the voltage difference ΔELVDD to a maximum value Vregm1 of the first gamma reference voltage Vreg1. The gamma reference voltage compensation unit 258 can generate the first voltage level (i.e., the maximum level VregP2') of the second compensation gamma reference voltage Vreg2' by applying the voltage difference ΔELVDD to the maximum value Vregm2 of the second gamma reference voltage Vreg2. In some embodiments, the gamma reference voltage compensation unit 258 determines the second voltage level by subtracting the voltage difference ΔELVDD from the maximum value of the gamma reference voltage of the frame. For example, the gamma reference voltage compensation unit 258 determines the maximum value VregP1' by subtracting the voltage difference ΔELVDD from the maximum value VregP1 of the first gamma reference voltage Vreg1. The gamma reference voltage compensation unit 258 can determine the maximum value VregP2' by subtracting the voltage difference ΔELVDD from the maximum value VregP2 of the second gamma reference voltage Vreg2. For example, the first voltage level (e.g., the maximum value Vregm1') is calculated by an equation of VregP1'=VrefP1−ΔELVDD, and the first voltage level (e.g., the maximum value Vregm2') of the second compensation gamma reference voltage Vreg2' is calculated by an equation of VregP2'=VrefP2−ΔELVDD.

In some embodiments, a gamma reference voltage offset matched to the voltage difference ΔELVDD of the first power voltage ELVDD is added to and subtracted from the first and second gamma reference voltages Vreg1 and Vreg2. The gamma reference voltage offset can be matched in accordance with the voltage difference ΔELVDD to be realized by a table. The gamma reference voltage offset can be drawn by an algorithm and can be drawn by synthesizing a repetitive experiment result value. However, a method of applying the voltage difference ΔELVDD to the first gamma reference voltage Vreg1 and the second gamma reference voltage Vreg2 is not limited to the above. Various mathematical and experimental methods can be applied.

When the average gray level is maintained to have uniform level (e.g., the same image is continuously displayed in some frames), the gamma reference voltage compensation unit 258 can set the minimum level Vregm1' and the minimum level Vregm2' referring to the LUT 254. Thus, when the average gray level is maintained to have uniform level, even though the voltage difference ΔELVDD is changed by the change of luminance level of the image data, the minimum level Vregm1' and the minimum level Vregm2' are not changed.

As illustrated in FIG. 8, in some embodiments, the OLED display 100 emitting light of gray level 255 (or full-white display) changes the luminance level (or the dimming level) of the same image. The voltage drop of the first power voltage ELVDD can increase as the luminance level (or the dimming level) of the image increases. (i.e., the detected voltage level Vrp decreases.)

The gamma reference voltage compensation unit 258 can determine the minimum value Vregm1' and the minimum value Vregm2' corresponding the average gray level 255 by referring to the LUT 254. For example, as illustrated in FIG. 8, the minimum value of the first compensation gamma reference voltage Vreg1' is about 6.0V, and the minimum value VregP2' is about 1.0V. The gamma reference voltage compensation unit 258 can output the minimum value VregP1' and the minimum value VregP2' during the second period P2.

The detection unit 256 can calculate the voltage difference ΔELVDD between the detected voltage level Vrp of the first power voltage ELVDD at the detection point RP of the display panel and the reference voltage Vref. For example, if the reference voltage is about 4.5V and the detected voltage level Vrp is about 4.57V, the voltage difference ΔELVDD is about 0.07V.

If the maximum value VregP1 is about 6.1V and the maximum value VregP2 of the second gamma reference voltage Vreg2 is about 1.1V, the maximum value VregP1' can be determined to be about 6.03V (i.e., 6.1V−0.07V=6.03V) and the maximum value VregP2' can be determined to be about 1.03V (i.e., 1.1V−0.07V=1.03V).

The data signal generated based on the first and second gamma reference voltages Vreg1 and Vreg2 can be applied to the first area A of the display panel 110 during a first duration P1 of one frame 1F, and to the second area B of the display panel 110 during a second duration P2 of the frame 1F. Here, the first power voltage ELVDD can substantially linearly decrease in the display panel 110 as a position of the display panel is farther from the data driver 130. The first duration P1 can correspond to a duration in which the data signal is applied to a first area A. The second duration P2 can correspond to a duration in which the data signal is applied to a second area B.

The voltage drop of the first power voltage ELVDD in the display panel 110 can decrease as the luminance level decreases such that an amount of current applied to the pixels decrease. Thus, the detected voltage level Vrp at the detection point RP can increase. As the detected voltage level Vrp increases, the voltage difference ΔELVDD increases and the maximum value VregP1' and the maximum value VregP2' decrease. Therefore, as the luminance level of the display panel 110 decreases (i.e., low luminance level is displayed), a voltage difference ΔV3 and ΔV4 between the maximum value VregP1' and VregP2' and the minimum value Vregm1' and Vregm2' can decrease.

As a result, when the display panel 110 displays an image to have high luminance (i.e., the voltage drop of the first power voltage ELVDD is large), the gamma reference voltage generator 150 increases the voltage difference ΔV1 and ΔV2 between the maximum value VregP1' and VregP2' and the minimum value Vregm1' and Vregm2' such that the deviation of the luminance between the first area A and the second area B can be removed (can be improved). In contrast, when the display panel 110 displays an image to have low luminance (i.e., the voltage drop of the first power voltage ELVDD is very small), the voltage difference ΔV1 and ΔV2 between the maximum value VregP1' and VregP2' and the minimum value Vregm1' and Vregm2' can decrease such that the deviation of the luminance between the first area A and the second area B can be removed (can be improved).

However, above described operation is not limited thereto. For example, when the luminance level (or the dimming level) is maintained to have a substantially uniform level and the gray level is changed, the voltage difference ΔV3 and ΔV4 between the the maximum value VregP1' and VregP2' and the minimum value Vregm1' and Vregm2' is adjusted according to the change of the gray level of the image by adjusting the maximum value VregP1' and VregP2' of the compensation gamma reference voltage Vreg1' and Vreg2'.

As described above, the OLED display 200 according to example embodiments determines the second voltage level (e.g., the minimum value) of the compensation gamma reference voltage Vreg' referring to the LUT 254 and only adjusts the first voltage level (e.g., the maximum level) of the compensation gamma reference voltage Vreg' based at least in part on the voltage difference ΔELVDD (i.e., based on change of the luminance level) when the average gray level of the image is maintained to have a substantially uniform level. For example, the voltage difference between the first and second voltage levels of the compensation gamma reference voltage Vreg' is adjusted based at least in part on the change of the luminance level (or the dimming level). Thus, optimal gamma voltage (or data voltage) based on the compensation gamma reference voltage can be selected based at least in part on the luminance level such that the deviation of luminance between internal areas of the display panel 110 can be effectively removed.

Figure 9:
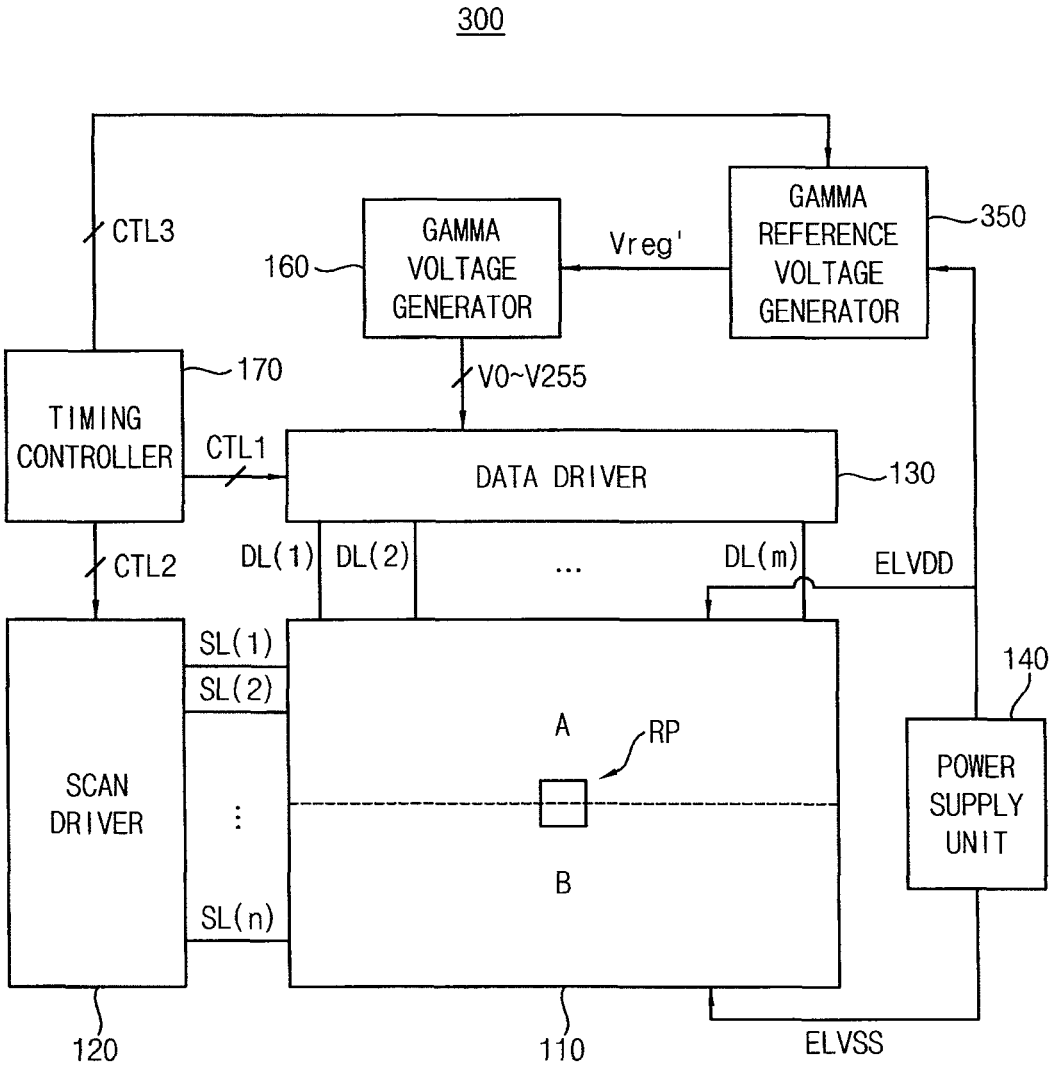
FIG. 9 is a block diagram of an OLED display according to example embodiments.

FIG. 9 is a block diagram of an OLED display according to example embodiments.

In FIG. 9, like reference numerals are used to designate elements of the OLED display in FIGS. 1 to 8, and detailed description of these elements can be omitted. The OLED display of FIG. 9 can be substantially the same as or similar to the OLED display of FIG. 1 except for the gamma reference voltage generator 350. Like reference numerals are used to represent like elements.

Referring to FIG. 9, the OLED display 200 can include a display panel 110, a scan driver 120, a data driver 130, a power supply unit 140, a gamma reference voltage generator 350, a gamma voltage generator 160, and a timing controller 170.

The gamma reference voltage generator 350 can output a compensation gamma reference voltage Vreg' of a gamma reference voltage to change to a second voltage level from a first voltage level within a frame based on a detected voltage level of the first power voltage ELVDD detected at the display panel 110. The gamma reference voltage generator 350 can determine the first voltage level of the compensation gamma reference voltage Vreg' according to a luminance level of the display panel 110 that corresponds to a dimming level of the display panel 110. The gamma reference voltage generator 350 can determine the second voltage level of the compensation gamma reference voltage Vreg' according to an average gray level of the display panel 110. In some embodiments, the gamma reference voltage generator 350 generate N (N is a positive integer) gamma reference voltages and N compensation gamma reference voltages each having different voltage level.

The gamma reference voltage generator 350 can include a detection unit calculating a voltage difference ΔELVDD between the detected voltage level Vrp of the first power voltage ELVDD at the detection point RP of the display panel 110 and a reference voltage and a gamma reference voltage compensation unit generating the compensation gamma reference voltage Vreg' of the gamma reference voltage.

The gamma reference voltage generator 350 can further include a luminance level detection unit detecting a luminance level of the display panel 110 and a first lookup table (LUT) having the first voltage level of the compensation gamma reference voltage Vreg' corresponding to the luminance level. In some embodiments, the first LUT has maximum values of the compensation gamma reference voltage corresponding to the respective luminance levels.

The gamma reference voltage generator 350 can further include a gray level detection unit detecting an average gray level of the display panel 110 based at least in part on an image data and a second LUT having the second voltage level of the compensation gamma reference voltage Vreg' corresponding to the luminance level. In some embodiments, the second LUT has minimum values of the compensation gamma reference voltage Vreg' corresponding to the respective average gray levels.

When the luminance level is maintained to have a substantially uniform level and the average gray level is changed, the gamma reference voltage generator 350 can determine the first voltage level of the compensation gamma reference voltage Vreg' referring to the first LUT that has the first voltage level of the compensation gamma reference voltage Vreg' corresponding to the luminance level. The gamma reference voltage generator 350 can determine the second voltage level of the compensation gamma reference voltage Vreg' based at least in part on a voltage difference between the detected voltage level of the first power voltage ELVDD at a detection point of the display panel 110 and a reference voltage. In some embodiments, the gamma reference voltage generator 350 determines the second voltage level of the compensation gamma reference voltage Vreg' by adding the voltage difference to a minimum value of the gamma reference voltage of the frame. Since these are described above referred to FIGS. 1 to 4, duplicated descriptions will not be repeated.

When the average gray level is maintained to have a substantially uniform level and the luminance level is changed, the gamma reference voltage generator 350 can determine the first voltage level of the compensation gamma reference voltage Vreg' based at least in part on the voltage difference between the detected voltage level of the first power voltage at the detection point of the display panel and a reference voltage. The gamma reference voltage generator 350 can determine the second voltage level of the compensation gamma reference voltage Vreg' referring to the second LUT that has the second voltage level of the compensation gamma reference voltage Vreg' corresponding to the average gray level. In some embodiments, the gamma reference voltage generator 350 determines the first voltage level of the compensation gamma reference voltage Vreg' by subtracting the voltage difference from a maximum value of the gamma reference voltage of the frame. Since these are described above referred to FIGS. 5 to 8, duplicated descriptions will not be repeated.

In some embodiments, the first voltage level is a maximum value of the compensation gamma reference voltage Vreg', and the second voltage level is a minimum value of the compensation gamma reference voltage Vreg'.

As described above, the OLED display 300 according to example embodiment determines optimal compensation gamma reference voltage Vreg' based at least in part on the average gray level or the luminance level such that the deviation of luminance between internal areas of the display panel 110 can be effectively removed.

The present embodiments can be applied to any OLED display including a gamma reference voltage generator and any system including the OLED display. For example, the present embodiments are applied to televisions, computer monitors, laptop computers, digital cameras, cellular phones, smartphones, smart pads, personal digital assistants (PDAs), portable multimedia players (PMPs), MP3 players, navigation systems, game consoles, video phones, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined in the claims. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

What is claimed is:

1. An organic light-emitting diode (OLED) display, comprising:

a display panel including a plurality of pixels and having a plurality of luminance levels at respective points on the display panel;

a power supply unit configured to provide first and second power voltages to the display panel;

a gamma reference voltage generator configured to i) generate a compensation gamma reference voltage, ii) detect a voltage level of the first power voltage at a detection point of the display panel, iii) change the compensation gamma reference voltage from a first voltage level to a second voltage level within a frame based at least in part on the detected voltage level, and iv) determine the first voltage level of the compensation gamma reference voltage based at least in part on one of the plurality of luminance levels at the respective points on the display panel;

a gamma voltage generator configured to divide the compensation gamma reference voltage so as to output a plurality of gamma voltages; and a data driver configured to generate a data signal corresponding to the gamma voltages and provide the data signal to the display panel, wherein the gamma reference voltage generator is further configured to:

substantially linearly decrease the compensation gamma reference voltage from the first voltage level to the second voltage level during a first duration of the frame, wherein the first duration corresponds to a duration in which the data signal is applied to a first area of the display panel, wherein the first area is closer to the data driver than the detection point, and maintain the second voltage level during a second duration of the frame after the first duration, wherein the second duration corresponds to a duration in which the data signal is applied to a second area of the display panel, wherein the second area includes a remaining area of the display panel adjacent to the first area.

2. The display device of claim 1, wherein the gamma reference voltage generator comprises:

a luminance level detector configured to detect the plurality of luminance levels;

a lookup table storing the first voltage level of the compensation gamma reference voltage corresponding to each of the plurality of luminance levels;

a detector configured to calculate a voltage difference between the detected voltage level at the detection point of the display panel and a reference voltage; and a gamma reference voltage compensation unit configured to i) receive the first voltage level of the compensation gamma reference voltage from the lookup table, and ii)

determine the second voltage level of the compensation gamma reference voltage based at least in part on the voltage difference.

3. The display device of claim 2, wherein the first and second voltage levels respectively include maximum and minimum values of the compensation gamma reference voltage of the frame.

4. The display device of claim 3, wherein the gamma reference voltage compensation unit is further configured to add the voltage difference to the minimum value of the gamma reference voltage of the frame so as to determine the second voltage level of the compensation gamma reference voltage.

5. The display device of claim 2, wherein the detector is further configured to detect the voltage level when the display panel emits light having a maximum luminance level and a maximum gray level, and wherein the reference voltage corresponds to the detected voltage level.

6. The display device of claim 1, wherein the detection point corresponds to a portion of a center line of the display panel, and wherein the center line is substantially parallel to the scan line.

7. An organic light-emitting diode (OLED) display, comprising:

a display panel including a plurality of pixels and having an average gray level at respective points on the display panel;

a power supply unit configured to provide first and second power voltages to the display panel;

a gamma reference voltage generator configured to i) generate a compensation gamma reference voltage of a gamma reference voltage, ii) detect a voltage level of the first power voltage at the display panel, iii) change the compensation gamma reference voltage from a first voltage level to a second voltage level within a frame based at least in part on the detected voltage level, and iv) determine the second voltage level of the compensation gamma reference voltage based at least in part on the average gray level at respective points on the display panel;

a gamma voltage generator configured to divide the compensation gamma reference voltage so as to output a plurality of gamma voltages; and a data driver configured to generate a data signal corresponding to the gamma voltages and provide the data signal to the display panel, wherein the gamma reference voltage generator is further configured to:

substantially linearly decrease the compensation gamma reference voltage from the first voltage level to the second voltage level during a first duration of the frame, wherein the first duration corresponds to a duration in which the data signal is applied to a first area of the display panel, wherein the first area is closer to the data driver than the detection point, and maintain the second voltage level during a second duration of the frame after the first duration, wherein the second duration corresponds to a duration in which the data signal is applied to a second area of the display panel, wherein the second area includes a remaining area of the display panel adjacent to the first area.

8. The display device of claim 7, wherein the gamma reference voltage generator comprises:

a gray level detector configured to detect the average gray level based at least in part on image data;

a lookup table storing the second voltage level of the compensation gamma reference voltage corresponding to the average gray level;

a detector configured to calculate the voltage difference between the detected voltage level at a detection point of the display panel and a reference voltage; and a gamma reference voltage compensation unit configured to i) receive the second voltage level of the compensation gamma reference voltage from the lookup table, and ii) determine the first voltage level of the compensation gamma reference voltage based at least in part on the voltage difference.

9. The display device of claim 8, wherein the first and second voltage levels respectively include maximum and minimum values of the compensation gamma reference voltage.

10. The display device of claim 9, wherein the gamma reference voltage compensation unit is further configured to subtract the voltage difference from the maximum value of the gamma reference voltage of the frame so as determine the first voltage level of the compensation gamma reference voltage.

11. The display device of claim 9, wherein the detector is further configured to detect the voltage level when the display panel emits light having a maximum luminance level and a maximum gray level, and wherein the reference voltage corresponds to the detected voltage level.

12. An organic light-emitting diode (OLED) display, comprising:

a display panel including a plurality of pixels and having an average gray level and a luminance level of the display panel;

a power supply unit configured to provide first and second power voltages to the display panel;

a gamma reference voltage generator configured to i) generate a compensation gamma reference voltage of a gamma reference voltage, ii) detect a voltage level of the first power voltage at the display panel, iii) change the compensation gamma reference voltage from a first voltage level to a second voltage level within a frame based at least in part on the detected voltage level, iv) determine the first voltage level of the compensation gamma reference voltage based at least in part on the luminance level and v) determine the second voltage level of the compensation gamma reference voltage based at least in part on the average gray level;

a gamma voltage generator configured to divide the compensation gamma reference voltage so as to output a plurality of gamma voltages; and a data driver configured to generate a data signal corresponding to the gamma voltages and provide the data signal to the display panel, wherein, when the luminance level is maintained to have a substantially uniform level and the average gray level is changed, the gamma reference voltage generator is further configured to i) receive the first voltage level from a first lookup table having the first voltage level corresponding to the luminance level, and ii) determine the second voltage level based at least in part on a voltage difference between the detected voltage level and a reference voltage, and wherein, when the average gray level is maintained to have a substantially uniform level and the luminance level is changed, the gamma reference voltage generator is further configured to i) determine the first voltage level of the compensation gamma reference voltage based at least in part on the voltage difference between the detected voltage level and the reference voltage, and ii) receive the second voltage level from a second lookup table having the second voltage level corresponding to the average gray level.

* * * * *